US005167322A

United States Patent [19]

Lemaire

[11] Patent Number: 5,167,322

[45] Date of Patent: Dec. 1, 1992

[54] HEADER CONSTRUCTION FOR PACKAGE ROLL OF SHEET MATERIAL

[75] Inventor: Alain Lemaire, Kingsey Falls, Canada

[73] Assignee: Cascades Conversion Inc., Kingsley-Falls, Canada

[21] Appl. No.: 813,534

[22] Filed: Dec. 26, 1991

Related U.S. Application Data

[63] Continuation of Ser. No. 647,261, Jan. 29, 1991, abandoned.

[51] Int. Cl.[5] ..... B65D 85/66; B65D 85/64

[52] U.S. Cl. ..... 206/410; 206/397; 206/389; 206/413; 206/416

[58] Field of Search ..... 206/416, 415, 413, 410, 206/408, 397, 389, 586, 453

[56] References Cited

U.S. PATENT DOCUMENTS

| | | | |
|---|---|---|---|
| 1,260,491 | 3/1918 | Weaver | 206/415 |
| 2,241,458 | 5/1941 | Heizer | 206/413 |
| 3,341,002 | 9/1967 | Fronczek | 206/408 |
| 3,685,644 | 8/1972 | Cothran et al. | 206/408 |
| 3,942,638 | 3/1976 | Stone | 206/416 |
| 4,858,762 | 8/1989 | Kewin | 206/414 |

*Primary Examiner*—Paul T. Sewell
*Assistant Examiner*—Marie D. Patterson

[57] ABSTRACT

A package roll of paper or other sheet material comprised of a cylinder core about which paper is wound into a roll. A wrapper is wrapped around the roll of paper. An inside header is secured over the end walls of the roll by the overhang portions of the wrapper which is crimped over a peripheral outer edge portion of the header positioned thereon. The inside header has a base wall of substantially the same diameter as the roll and disposed over the end walls. The overhang edge portions are crimped about the outer peripheral edge portion of an outer face of the base wall. A support disc of smaller predetermined surface area, relative to the diameter of the roll, is secured to the outer face of the base wall to support the roll when positioned on one of its ends and to relieve pressure from outer end edges of the roll of paper. An outside header is secured over the support disc and crimped edge portions of the wrapper.

5 Claims, 1 Drawing Sheet

HEADER CONSTRUCTION FOR PACKAGE ROLL OF SHEET MATERIAL

This is a streamline continuation application of U.S. Ser. No. 647,261 filed Jan. 29, 1991, abandoned.

BACKGROUND OF INVENTION

1. Field of the Invention

The present invention relates to an improved header construction for securement at opposed ends of rolls of paper or other sheet material, and which is secured thereto by the overhang crimp of the wrapper which is wrapped about the roll 2. Description of Prior Art Paper rolls which are produced by the papermaking industry are usually stored and shipped standing, that is to say, positioned vertically on one of its ends and these rolls are often stacked end to end on one another. These rolls may be five or six feet in length and have diameters of three to four feet. Accordingly, these are very heavy, particularly when stacked end to end and any irregularity in its protective wrapping about their ends will result in punctures in the end edges of the roll of paper. When the roll is unwound, these irregularities cause crimps in the end edges of the paper sheet.

In an attempt to resolve such problems, various end wrapping structures have been proposed such as described in U.S. Pat. No, 4,858,762 where a complex end wrapping structure and procedure to improve cushioning over the ends of the rolls is described. This Patent suggests the use of a header assembly formed of a series of generally rectangular strips of material which are superposed one on top of the other in a star-like manner with central portions overlapping and scoured together. This assembly is effectuated after the wrapping paper has been crimped and glued together about the end edge portions of the roll of paper. The result of this superimposed position of strips is that it produces different thicknesses of material in the end edges and the only protection provided about the outer circumferential edge of the roll is the overlapped wrapper. These irregularities also result in markings on the end edges of the roll of paper, particularly when the roll of paper is so slightly moved from its vertical standing axis during handling when storing or shipping the rolls of paper. Another disadvantage of this structure is that it is complex and time consuming to assemble and often the strips of protective paper are misaligned which causes further irregularities. It is also pointed out that even if the strips of material are positioned over the end walls of the rolls prior to crimping the wrapper over the end walls, the circumferential edge is still not protected as the sheets are of rectangular cross section and have straight end edges. Also, when positioning the strips prior to the crimping, it is difficult to maintain them in alignment and this results in still further irregularities and susceptibility to crimping the end edge of the paper roll.

It is also pointed out that with the prior art packaged roll, if the overlap center section has a middle caliper which is more than the crimp caliper, the rolls would be unstable and rock. In stacking, this could cause a pile of rolls to collapse. On the other hand, if the middle caliper is less than the thickness of the crimp, then there is no extra protection given. Their design does not have an even thickness all the way around.

SUMMARY OF INVENTION

It is therefore a feature of the present invention to provide an improved header construction which is securable to the end walls of rolls of paper or the like sheet material and which substantially overcomes the above-mentioned disadvantages of the prior art.

According to a further feature of the present invention, there is provided an improved header assembly for securement over the end walls of rolls of paper or other sheet material and wherein an inside header is comprised of a base wall having a support disc of predetermined surface area secured thereto and which support disc is at least twice as thick as the base wall and at least as thick as the thickness of the overlapped edge portions of the wrapper.

According to the above features, from a broad aspect, the present invention provides a package roll of paper or other sheet material comprised of a cylinder core about which paper is wound into a roll. A wrapper is wrapped around the roll of paper. An inside header is secured over the end walls of the roll by the overhang portions of the wrapper which is crimped over a peripheral outer edge portion of the header positioned thereon. The inside header has a base wall of substantially the same diameter as the roll and disposed over the end walls. The overhang edge portions are crimped about the outer peripheral edge portion of an outer face of the base wall. A support disc of smaller predetermined surface area, relative to the diameter of the roll, is secured to the outer face of the base wall to support the roll when positioned on one of its ends and to relieve pressure from said crimped over portion of said wrapper sheet about said outer end edges of the roll of paper. An outside header is secured over the support disc and crimped edge portions of the wrapper.

BRIEF DESCRIPTION OF DRAWINGS

A preferred embodiment of the present invention will now be described with reference to the examples thereof as illustrated in the accompanying drawings in which.

DESCRIPTION OF PREFERRED EMBODIMENTS

Figure 1:
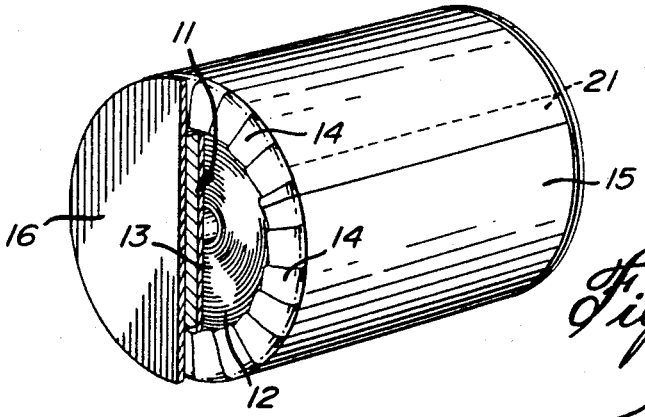
FIG. 1 is a perspective view of a package roll of paper utilizing the improved header construction of the present invention.

Referring now to the drawings, and more particularly to FIG. 1, there is shown generally at 10, a package roll of paper or other sheet material utilizing the inside header 11 of the present invention as secured in an end wall 12 of a roll of paper 13, such as newsprint. The header 11 is secured to the end wall by the circumferential overhang crimped edge portions 14 of a wrapper of material 15, herein Kraft paper. An outside header, herein a disc of paper board 16, extends from the overlapped crimp portions 14 and overlaps the support disc 17 of the inside header 11. This disc 16 is poly coated and heat is applied to penetrate the board and melt the poly, while the poly is soft and sticky, it is pressed over the end wall. Other types of adhesive means may be provided to secure the disc 16 to the end wall.

Figure 2:
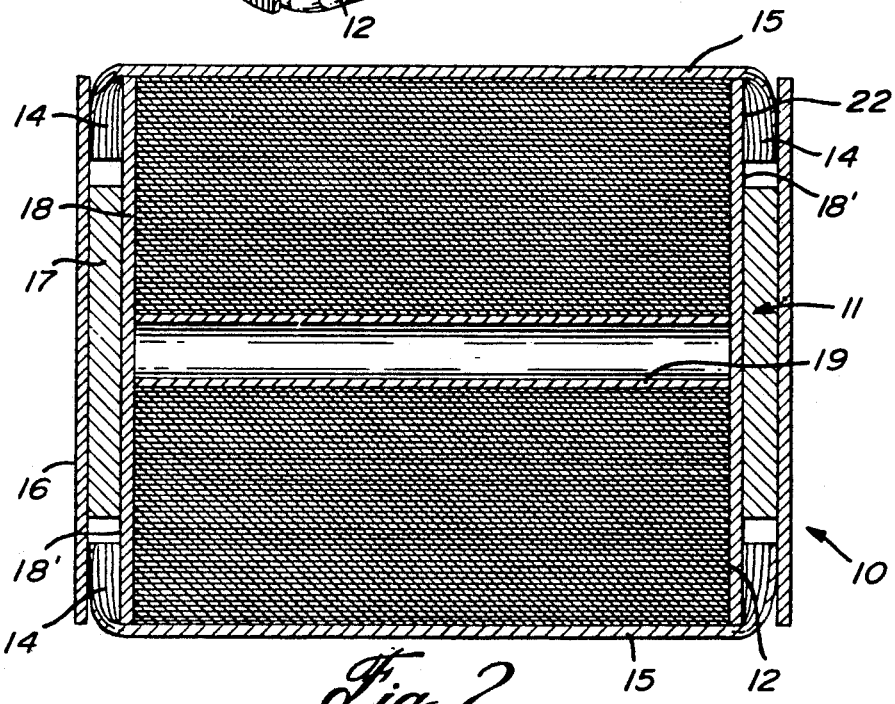
FIG. 2 is a section view of a package roll of paper utilizing the headers of the present invention.
Figure 3A:
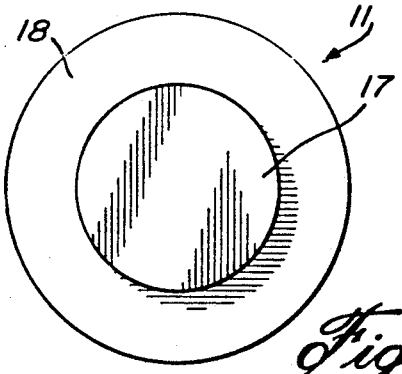
FIG. 3A is a plan view of a header having a circular support disc.
Figure 4A:
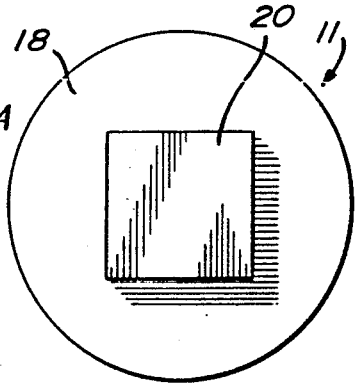
FIG. 4A is a plan view of another example of a header constructed in accordance with the present invention and wherein the support disc has a square contour, or any polygonal contours.
Figure 3B:
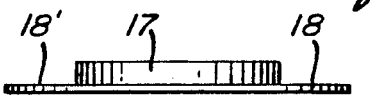
FIG. 3B is an end view of FIG. 3A.
Figure 4B:
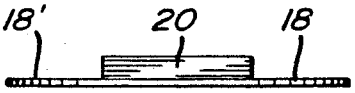
FIG. 4B is an end view of FIG. 4A.

Referring now additionally to FIGS. 2 to 4, it can be seen that the inside header 11 is comprised of a base disc or wall 18 formed of cardboard material and over a surface of which is attached, such as by gluing, a support disc 17 of predetermined surface area relative to the diameter of the roll of paper to be protected. The diameter or surface area of the support disc 17 is selected such as to give stability to the roll of paper when supported on its end wall 12 and is selected to fit within the crimped circumferential edge portions 14 of the wrapper 15.

The support disc 17 has a thickness which is at least twice that of the base wall 18 and at least as thick as the crimped portions 14. The cardboard material utilized in the construction of the base wall 18 and the support disc 17 is a solid core cardboard material such as to have resistance to compression when rolls of papers are stacked end to end one on top of another. The diameter or surface area of the support disc 17 is large enough to also give these rolls vertical stability. The disc also removes the pressure from the crimped portions 14 of the wrapper 15, in an area where the roll would be more susceptible to damage. The core 19 disposed at the center of the paper roll also imparts rigidity to the roll and rests centrally against the inside header 11 and, therefore, the weight of the rolls is concentrated at the center thereof which is the area where the support disc provides maximum cushioning effect.

The outside header 16 may be formed as a cardboard disc or simply a disc of paper which is adhered over the crimped portion 14 and the external surface 17' of the support disc 17.

As shown in FIG. 4, the inside header may also be provided with a support disc 20 which has a square contour or any polygonal contours. Accordingly, the disc 20 necessitates less material and there is less waste as with circular discs. Its construction is also simplified.

To give an idea of the size of the headers, for a 40" diameter roll of paper, the base wall 18 of the inside header was 39" in diameter and the support disc 17 was 22" in diameter. The thickness of the base wall was 0.045" while the thickness of the support disc was 0.125". Such header was found to provide adequate protection to the end edges of the paper in the roll and also gave good vertical stability to the rolls when supported vertically on one of its ends and in a stacked array.

Briefly summarizing the assembly, the inside header is positioned against the end wall 12 of a roll of paper 10 with the base wall extending against the end wall and the support disc being disposed externally. The wrapper 15 is then secured with its overlapping edges 21 (see FIG. 1) and overhang portions of the wrapper extend beyond the end walls 12 of the roll. These overhang portions 14 are then crimped over the peripheral outer edge portion of the outer face of the base wall 15 and may be glued thereabout by placing a glue, such as at 22, about the periphery of the outer face 18" of the base wall 18. The outer header 16 is then adhered to the end wall assembly and is disposed over the crimped edge portions 14 and the support disc 17. As can be seen, the end headers are simple to assemble and the end edges of the roll of paper are protected by the header positioned thereagainst. Also, when the roll is supported on its end wall, there are no irregularities in the support surface as the weight of the roll is supported through the support disc 17 which is of constant thickness and the circumferential edges of the roll having the crimped end irregularities being relieved of pressure thereby not scoring or damaging the edges of the paper roll.

It is within the ambit of the present invention to cover any obvious modifications of the examples of a preferred embodiment described herein provided such modifications fall within the scope of the appended claims.

I claim:

1. A packaged paper roll having reinforced opposed end walls formed entirely of paper and cardboard, said roll comprising an open-ended cylinder core about which a paper sheet is wound to form a roll, an inside header formed of a paperboard disc base wall disposed entirely over opposed end walls of said roll and obstructing said open-ended cylinder core and wound end edges of said paper sheet, a paper wrapper sheet wrapped around said roll with opposed overhand circumferential edge portions crimped over an outer peripheral edge portion of said opposed end walls and over said inside header, said crimped circumferential edge portions of said wrapper sheet having an irregular thickness, a support disc of solid core paperboard material secured concentrically to an outer surface of said inside header, said support disc having a predetermined size relative to the diameter of said roll and spaced closely inside said crimped circumferential edge portions, said support disc further having a thickness which is at least as thick as said crimped circumferential edge portions of said wrapper to relieve pressure therefrom when said roll is supported vertically on its end wall to prevent the formation of markings on said end edges of said roll of paper sheet by said crimped circumferential edge portions of irregular thickness, and an outer header of uniform thickness is secured over an outer face of said support disc and circumferential edge portions of said wrapper.

2. A packaged roll as claimed in claim 1 wherein said support disc is at least twice as thick as said base wall.

3. A packaged roll as claimed in claim 2 wherein said outside header is a paperboard disc glued under pressure.

4. A packaged roll as claimed in claim 2 wherein said support disc has a circular contour.

5. A packaged roll as claimed in claim 2 wherein said support disc is a square contour disc.

* * * * *